United States Patent [19]

Nemoto et al.

[11] Patent Number: 5,000,876

[45] Date of Patent: Mar. 19, 1991

[54] VOLTAGE NON-LINEAR TYPE RESISTORS

[75] Inventors: Hiroshi Nemoto, Nagoya; Koichi Umemoto, Toyota, both of Japan

[73] Assignee: NGK Insulators, Ltd., Japan

[21] Appl. No.: 279,059

[22] Filed: Dec. 2, 1988

[30] Foreign Application Priority Data

Dec. 7, 1987 [JP] Japan ..... 62-307722

[51] Int. Cl.[5] ..... H01B 1/06

[52] U.S. Cl. ..... 252/518; 252/519

[58] Field of Search ..... 252/518, 519; 338/20; 264/61, 60

[56] References Cited

U.S. PATENT DOCUMENTS 4,111,852 9/1978 Ho et al. ..... 252/518
4,180,483 12/1979 Ho et al. ..... 252/518
4,184,984 1/1990 Levinson ..... 252/518

FOREIGN PATENT DOCUMENTS 241150 10/1987 European Pat. Off. .
316015 5/1989 European Pat. Off. .

*Primary Examiner*—Josephine Barr
*Attorney, Agent, or Firm*—Arnold, White & Durkee

[57] ABSTRACT

A voltage non-linear type sintered resistor is disclosed, which is produced by reacting, under heating, a mixture consisting essentially of zinc oxide as a main component, and an additive exhibiting voltage non-linearity and silicon oxide as auxiliary components. The silicon oxide is contained in an amount of 0.3 to 4.0 mol % with respect to the sintered resistor when calculated as $SiO_2$, and the average particle diameter of crystalline grains of the zinc oxide constituting the sintered body is not more than 6 $\mu$m.

9 Claims, No Drawings

VOLTAGE NON-LINEAR TYPE RESISTORS

BACKGROUND OF THE INVENTION (1) Field of the Invention:

The present invention relates to voltage non-linear type resistors composed mainly of zinc oxide. More particularly, the invention relates to voltage non-linear type resistors to be used in overvoltage-protecting devices such as lightning arrestors.

(2) Related Art Statement:

Since the voltage non-linear type resistors composed mainly of zinc oxide have excellent non-linear voltage-current characteristics, they are widely used in lightning arrestors or surge absorbers to stabilize the voltage or to absorb surges. The voltage non-linear type resistor is produced by adding and mixing a small amount of an oxide or oxides of bismuth, antimony, cobalt and/or manganese into zinc oxide as the main component, granulating and shaping the mixture, firing the shaped body, and attaching electrodes to the sintered body.

The sintered body is composed of zinc oxide and intergranular layers formed from particles of the additives. It is considered that the excellent non-linear voltage current characteristic is attributable to interfaces between the grains of zinc oxide and the intergranular layers. The breakdown voltage of the voltage non-linear type resistor depends upon the intergranular layers existing between the electrodes. Thus, when considered with respect to the unit thickness, the breakdown voltage is dependent upon the size of grains of zinc oxide constituting the sintered body. The breakdown voltage is a voltage occurring in the voltage non-linear type resistor when a given electric current passes therethrough. The breakdown voltage is ordinarily considered per unit thickness (1 mm) with respect to an electric current of 1 mA/cm$^2$.

In order to increase the breakdown voltage of the voltage non-linear resistor, only the growth of the grains of zinc oxide constituting the sintered body need be controlled. In order to control the grain growth, for example, there has been conventionally employed a process for decreasing a sintering temperature, or a process for incorporating a grain growth controlling agent such as silicon oxide into the resistor.

However, the sintering temperature-decreasing process has problems in that the additive assisting the sintering through the formation of a liquid phase is not sufficiently dispersed into the surrounding, and thus, densification does not occur during the sintering. Further, and that since other additives are not dispersed well, the resistor will not exhibit excellent non-linear voltage-current characteristics. For this reason, the breakdown voltage attainable in this process is practically about 300 V/mm at a maximum.

On the other hand, for instance, Japanese patent publication Nos. 55-13,124 and 59-12,001 disclose a silicon oxide-incorporating process. In this process, a far greater amount of silicon oxide is contained in the resistor as compared with that of elements ordinarily produced Although silicon oxide precipitates in the grain boundaries as zinc silicate and controls the grain growth, it interrupts flow of electric current, because the silicate is an extremely electrically insulating material Therefore, if the content of silicon oxide is great, an amount of the silicate precipitated in the grain boundaries increases Consequently, the electric current distribution is disturbed, and becomes non-uniform. Further, since the voltage non-linear resistor has a negative temperature coefficient of resistance, local concentration of electric current is likely to occur when the electric current distribution is disturbed and non-uniform. That is, if electric current is concentrated at a certain location, the resistance decreases there owing to greater temperature rise with Joule heat as compared with the other location. In this case, the concentration of the electric current further becomes more conspicuous, and an actual area of the flow passage effective for the electric current decreases. As a result, the electric current flows through a part of the voltage non-linear type resistor. Due to this, such a resistor cannot be applied to lightning arrestors which require the suppression of great surges of electric current.

SUMMARY OF THE INVENTION

It is an object of the present invention to eliminate the above-mentioned drawbacks, and to provide a zinc oxide voltage non-linear type resistor, which has such a high breakdown voltage per unit thickness as enabling compactness of lightning arrestors and which can be used in high voltage lightning arrestors, particularly 500 kV electric power lightning units, more particularly, future UHV high voltage lightning arrestors.

According to the present invention, there is a provision of a voltage non-linear type sintered resistor which is produced by reacting a mixture containing zinc oxide as a main ingredient and an additive exhibiting the voltage non-linearity and 0.3 to 4.0 mol.%, when calculated as $SiO_2$, of silicon oxide as an auxiliary ingredient through heating, and in which the average particle diameter of crystals of the zinc oxide constituting the sintered resistor is not more than 6 μm, and the breakdown voltage is not less than 500 V/mm per unit thickness of the sintered body with respect to an electric current density of 1 mA/cm$^2$.

These and other objects, features and advantages the invention will be appreciated upon reading of the following description of the invention, with the understanding that some modifications, variations and changes of the same could be made by the skilled person in the art to which the invention pertains without departing from the spirit of the invention or the scope of claims appended hereto.

DETAILED DESCRIPTION OF THE INVENTION

The voltage non-linear type resistor according to the present invention is obtained by mixing, for instance, at least one material selected from the group consisting essentially of cobalt oxide, manganese oxide, chromium oxide, and nickel oxide as an additive exhibiting voltage non-linearity, and bismuth oxide, antimony oxide, and silicon oxide to the main component of zinc oxide at specific ratios, granulating the mixture, shaping the granules in a given form, and sintering the shaped body at temperatures not higher than 1,050° C. by a hot press machine or a hot isostatic press machine while pressure is axially or isostatically applied. When the non-linear type resistor contains from 0.3 to 4.0 mol % of silicon oxide when calculated as $SiO_2$ and the average particle diameter of the crystalline grains of zinc oxide is not more than 6 μm, the breakdown voltage is not less than 500 V/mm.

The breakdown voltage per unit thickness of the voltage non-linear type resistor depends upon the number of the grain boundaries existing per unit thickness. In other words, it depends upon the size of grains of zinc oxide and the breakdown voltage per one grain boundary. The breakdown voltage per grain boundary depends upon the chemical composition, while the size of the grains of zinc oxide depends upon the chemical composition and the firing temperature. Therefore, since the breakdown voltage of the voltage non-linear type resistor cannot be determined by the chemical composition only. As stated above, the breakdown voltage is determined by the chemical composition of the sintered body and the size of the grains of zinc oxide constituting the sintered body.

In the following, examples of the present invention will be explained. They are merely in illustration thereof, and should never be interpreted to limit the scope of the invention.

Experiment 1

To ZnO as a main component were added and mixed small amounts of $Bi_2O_3$, $Sb_2O_3$, $Co_2O_3$, $Cr_2O_3$, $MnO_2$, NiO, $SiO_2$, $Al_2O_3$, and $B_2O_3$, water, a binder, and a dispersant. The mixture was granulated by a spray drier, and shaped into a cylindrical form, 43 mm in diameter and 40 mm thick. The shaped body was then heated at about 500° C. to remove the binder and the dispersant, and a sintered at a temperature of 900° C. in air under a pressure of 200 kg/cm$^2$ for one hour by using a hot press machine. The hot press conditions are preferably that the temperature, the pressure and the time are 850° C. to 1,000° C., 100 to 300 kg/cm$^2$, and 0.5 to 2 hours, respectively. If the sintering is effected under the conditions with the respective lower limits, the sintered body is not sufficiently densified, while the average particle diameter of ZnO exceeds 6 μm with the conditions having the respective upper limits. The pressurizing was started from 700° C. in a temperature-ascending step, and terminated at 800° C. during a temperature-descending step. Thereafter, opposite surfaces of the sintered body were polished, and an aluminum electrode was formed on each of the polished surfaces by flame spraying. Thereby, a voltage non-linear type resistor was formed. With respect to the thus obtained voltage non-linear type resistor, the breakdown voltage per unit thickness under application of 1 mA/cm$^2$, the non-linearity index $\alpha$, and the surge withstanding capability under application of 2 ms rectangular wave electric current were measured. A planar sample was then cut from the voltage non-linear type resistor, mirror polished, and etched. The size of grains of zinc oxide constituting the sintered body was measured. Results are shown in Table 1, in which sintered bodies containing $SiO_2$ in an amount outside the range specified in the present invention and those ordinarily sintered in atmospheric pressure without using a hot press machine are also shown as Comparative Examples. In Table 1, the content of ZnO is not given, in Experiment 1, the ZnO content is obtained by subtracting the total molar percentage of the additives from 100 mol %. This is applicable to Experiment 2 mentioned later.

The voltage non-linearity index $\alpha$ was calculated by an equation $\alpha = 1/\log_{10}[V(1mA/cm^2)/V(0.1mA/cm^2)]$ in which $V(1mA/cm^2)$ and $V(0.1mA/cm^2)$ were voltages at electric current of 1 mA/cm$^2$ and 0.1 mA/cm$^2$, respectively The size of the grains of zinc oxide constituting the sintered body was obtained by measuring the standard deviation between the average particle diameter and diameters of the grains through observing an etched surface of the sintered body by means of an image analyzer.

TABLE 1

| | Composition (mol %) | | | | | | | | | Sintering | V(lmA/cm$^2$)/t | | Surge withstanding capability | Average particle diameter of zinc oxide in sintered body |
|---|---|---|---|---|---|---|---|---|---|---|---|---|---|---|
| | $Bi_2O_3$ | $Sb_2O_3$ | $Co_2O_3$ | $Cr_2O_3$ | $MnO_2$ | NiO | $SiO_2$ | $Al_2O_3$ | $B_2O_3$ | method | (V/mm) | $\alpha$ | (J/cm$^3$) | (μm) |
| Example 1 | 1.0 | 1.0 | 1.0 | 0.5 | 0.5 | 1.0 | 1.5 | 0.0025 | 0.005 | hot press | 1096 | 44 | 210 | 3 ± 1 |
| 2 | " | " | " | " | " | " | " | " | 0.3 | " | 1091 | 46 | 190 | " |
| 3 | " | " | " | " | " | " | " | 0.0005 | 0.1 | " | 1100 | 43 | 190 | " |
| 4 | " | " | " | " | " | " | " | 0.025 | " | " | 1103 | 37 | " | " |
| 5 | " | " | " | " | " | " | 0.3 | 0.0025 | " | " | 546 | 40 | 200 | 5 ± 3 |
| 6 | " | " | " | " | " | " | 4.0 | " | " | " | 1810 | 36 | 180 | 2 ± 1 |
| 7 | " | " | " | " | " | 0.1 | 1.5 | " | " | " | 1022 | 40 | 200 | 3 ± 1 |
| 8 | " | " | " | " | " | 3.0 | " | " | " | " | 1074 | 36 | " | " |
| 9 | " | " | " | " | 0.1 | 1.0 | " | " | " | " | 987 | 41 | " | " |
| 10 | " | " | " | " | 3.0 | " | " | " | " | " | 1002 | 43 | " | " |
| 11 | " | " | " | 0.1 | 0.5 | " | " | " | " | " | 1091 | 44 | " | " |
| 12 | " | " | " | 3.0 | " | " | " | " | " | " | 1104 | 41 | " | " |
| 13 | " | " | 0.1 | 0.5 | " | " | " | " | " | " | 815 | 36 | " | 4 ± 2 |
| 14 | " | " | 3.0 | " | " | " | " | " | " | " | 1090 | 42 | " | 3 ± 1 |
| 15 | " | 0.1 | 1.0 | " | " | " | " | " | " | " | 927 | 39 | " | " |
| 16 | " | 3.0 | " | " | " | " | " | " | " | " | 1200 | 41 | 190 | " |
| 17 | 0.1 | 1.0 | " | " | " | " | " | " | " | " | 899 | 30 | 200 | " |
| 18 | 3.0 | " | " | " | " | " | " | " | " | " | 1015 | 40 | " | " |
| 19 | 1.0 | " | " | " | " | " | " | " | " | " | 1113 | 45 | " | " |
| Comparative Example 1 | 1.0 | 1.0 | 1.0 | 0.5 | 0.5 | 1.0 | 0.1 | 0.0025 | 0.1 | hot press in air under ordinary pressure | 402 | 45 | 200 | 7 ± 4 |
| 2 | " | " | " | " | " | " | 6.0 | " | " | hot press in air under ordinary pressure | 2510 | 35 | 140 | 1 ± 0 |
| 3 | " | " | " | " | " | " | 1.5 | " | " | hot press in air under ordinary | 1030 | 24 | <100 | 3 ± 1 |

TABLE 1-continued

| Composition (mol %) | | | | | | | | | Sintering | V(lmA/ | | Surge with-standing capability | Average particle diameter of zinc oxide in sintered body |
|---|---|---|---|---|---|---|---|---|---|---|---|---|---|
| $Bi_2O_3$ | $Sb_2O_3$ | $Co_2O_3$ | $Cr_2O_3$ | $MnO_2$ | NiO | $SiO_2$ | $Al_2O_3$ | $B_2O_3$ | method | $cm^2$)/t (V/mm) | α | ($J/cm^3$) | (μm) |
| | | | | | | | | | pressure | | | | |

As is seen in Table 1, the average particle diameter of the grains constituting the sintered bodies and the standard deviation of the particle diameters in Examples 1 through 19 according to the present invention were as small as not more than 6 μm and was uniformly not more than 3 μm, respectively. The breakdown voltage was not less than 500 V/mm at an electric current of 1 $mA/cm^2$, and the surge withstanding capability was great.

As is shown in Comparative Example 1, if $SiO_2$ is less than 0.3 mol %, the average particle diameter of the grains of zinc oxide constituting the sintered body exceeded 6 μm, and the standard deviation was as much as 4 μm. The breakdown voltage was at a conventionally known level of not more than 400 V/mm. If $SiO_2$ exceeds 4 mol %, as shown in Comparative Example 2, the surge withstanding capability is lower than in Examples, although the average particle diameter of the grains of zinc oxide and the breakdown voltage are similar to the levels in Examples 1–19.

Experiment 2

Shaped bodies were prepared in the same manner as in Experiment 1, and thermally treated to remove a binder and a dispersant. Next, the shaped bodies were buried in zirconia powder charged in a capsule made of stainless steel (for instance, SUS 304), and the capsule was sealed while being evacuated under vacuum. The capsule was then placed in a hot isostatic press machine, and the shaped body was sintered at a temperature of 1,000° C. in argon under pressure of 600 $kg/cm^2$ for about one hour. The sintering conditions are preferably that the temperature, the pressure and the sintering time are 800° to 1,100° C., 300 to 1,200 $kg/cm^2$, and 0.2 to 2 hours, respectively. The reasons for these limitations are the same as described in Experiment 1. Thereafter, the sintered body was taken out from the capsule, and heated at a temperature of about 900° C. in air for 5 hours. The heating at 900° C. is necessary for exhibiting the voltage non-linearity by oxidizing the sintered body. After the heat treatment, as stated in Example 1, the sintered body was shaped in the form of a voltage non-linear type resistor, and measurements were carried out. Results are shown in Table 2. In Table 2, sintered bodies containing $SiO_2$ in an amount outside the present invention and those ordinarily sintered under atmospheric pressure without using the hot isostatic press machine are shown as Comparative Examples.

TABLE 2

| | Composition (mol %) | | | | | | | | | Sintering | Vl(mA/ | | Surge with-standing capability | Average particle diameter of zinc oxide in sintered body |
|---|---|---|---|---|---|---|---|---|---|---|---|---|---|---|
| | $Bi_2O_3$ | $Sb_2O_3$ | $Co_2O_3$ | $Cr_2O_3$ | $MnO_2$ | NiO | $SiO_2$ | $Al_2O_3$ | $B_2O_3$ | method | $cm^2$)/t (V/mm) | α | ($J/cm^3$) | (μm) |
| Example 1 | 1.0 | 1.0 | 1.0 | 0.5 | 0.5 | 1.0 | 1.5 | 0.0025 | 0.005 | hot press | 973 | 56 | 210 | 3 ± 1 |
| 2 | " | " | " | " | " | " | " | " | 0.3 | " | 972 | 57 | 190 | " |
| 3 | " | " | " | " | " | " | " | 0.0005 | 0.1 | " | 973 | 56 | 190 | " |
| 4 | " | " | " | " | " | " | " | 0.025 | " | " | 977 | 45 | " | " |
| 5 | " | " | " | " | " | " | 0.3 | 0.0025 | " | " | 515 | 51 | 200 | 6 ± 3 |
| 6 | " | " | " | " | " | " | 4.0 | " | " | " | 1589 | 50 | 180 | 2 ± 1 |
| 7 | " | " | " | " | " | 0.1 | 1.5 | " | " | " | 914 | 53 | 200 | 3 ± 1 |
| 8 | " | " | " | " | " | 3.0 | " | " | " | " | 950 | 46 | " | " |
| 9 | " | " | " | " | 0.1 | 1.0 | " | " | " | " | 855 | 52 | " | 4 ± 2 |
| 10 | " | " | " | " | 3.0 | " | " | " | " | " | 877 | 55 | " | " |
| 11 | " | " | " | 0.1 | 0.5 | " | " | " | " | " | 891 | 58 | " | " |
| 12 | " | " | " | 3.0 | " | " | " | " | " | " | 996 | 49 | " | 3 ± 1 |
| 13 | " | " | 0.1 | 0.5 | " | " | " | " | " | " | 778 | 42 | 190 | 4 ± 2 |
| 14 | " | " | 3.0 | " | " | " | " | " | " | " | 972 | 56 | 200 | 3 ± 1 |
| 15 | " | 0.1 | 1.0 | " | " | " | " | " | " | " | 815 | 49 | " | 4 ± 2 |
| 16 | " | 3.0 | " | " | " | " | " | " | " | " | 1133 | 52 | 190 | 3 ± 1 |
| 17 | 0.1 | 1.0 | " | " | " | " | " | " | " | " | 800 | 36 | 200 | 4 ± 2 |
| 18 | 3.0 | " | " | " | " | " | " | " | " | " | 944 | 51 | " | 3 ± 1 |
| 19 | 1.0 | " | " | " | " | " | " | " | " | " | 975 | 54 | " | 3 ± 1 |
| Comparative Example 1 | 1.0 | 1.0 | 1.0 | 0.5 | 0.5 | 1.0 | 0.1 | 0.0025 | 0.1 | hot press in air under ordinary pressure | 388 | 56 | 200 | 8 ± 5 |
| 2 | " | " | " | " | " | " | 6.0 | " | " | hot press in air under ordinary pressure | 2446 | 40 | 140 | 1 ± 0 |
| 3 | " | " | " | " | " | " | 1.5 | " | " | hot press in air under ordinary | 1030 | 24 | <100 | 3 ± 1 |

TABLE 2-continued

| Composition (mol %) | | | | | | | | | Sintering | Vl(mA/ | | Surge with-standing capability | Average particle diameter of zinc oxide in sintered body |
|---|---|---|---|---|---|---|---|---|---|---|---|---|---|
| $Bi_2O_3$ | $Sb_2O_3$ | $Co_2O_3$ | $Cr_2O_3$ | $MnO_2$ | NiO | $SiO_2$ | $Al_2O_3$ | $B_2O_3$ | method | $cm^2$)/t (V/mm) | α | ($J/cm^3$) | (μm) |
| | | | | | | | | | pressure | | | | |

As is seen in Table 2, even in Experiment 2, the average particle diameter of the grains of zinc oxide was not more than 6 μm and the breakdown voltage was not less than 500 V/mm under application of electric current of 1 $mA/cm^2$ in the case that the content of $SiO_2$ was in the range from 0.3 to 4.0 mol %. Thus, the surge withstanding capability was excellent.

As is shown in Comparative Examples of Tables 1 and 2, when the sintering was ordinarily effected under ordinary pressure in air, sufficient sintering was not effected at the same temperature as in the Examples of the present invention. Thus, dense sintered bodies could not be obtained, and surge withstanding capability was low.

Although changes in the performances when the content of $SiO_2$ was deviated from the range from 0.3 to 4.0 mol %, are shown in Comparative Examples of Tables 1 and 2 with respect to a single composition, this is applicable to the other compositions.

As is evident from the foregoing explanation, in the voltage non-linear type resistor according to the present invention, the size of the grains of zinc oxide constituting the sintered body can be reduced without increasing the content of silicon oxide. Consequently, the resistor having higher breakdown voltage can be obtained, and the lightning arrestors can be made compact. Thus, the invention is useful for 500 kV high voltage non-linear type lightning arrestors or future UHV use high voltage non-linear type lightning arrestors. Since the content of silicon oxide is small and the size of the grains of zinc oxide constituting the sintered body is relatively uniform,the electric current distribution is good. Therefore, the invention is favorably used in lightning arrestors.

What is claimed is:

1. A voltage non-linear sintered resistor body produced by reacting, under heating, a mixture consisting essentially of:

zinc oxide;

at least one additive selected from the group consisting of $Co_2O_3$, $MnO_2$, $Cr_2O_3$, NiO, $Bi_2O_3$, and $Sb_2O_3$, each in an amount of about 0.1–3.0 mol %; and about 0.3–4.0 mol % silicon oxide with respect to the sintered resistor when calculated as $SiO_2$;

wherein the average diameter of crystalline grains of zinc oxide constituting the sintered body is not more than 6 μm.

2. A voltage non-linear sintered resistor according to claim 5, wherein said sintered resistor has a breakdown voltage per unit thickness at a density of electric current of 1 $mA/cm^2$ of not less than 500 V/mm.

3. A voltage non-linear type sintered resistor according to claim 5, wherein the sintering is effected under axial application of pressure.

4. A voltage non-linear type sintered resistor according to claim 5, wherein the sintering is effected under the application of isostatic pressure.

5. A voltage non-linear type sintered resistor according to claim 5, wherein the sintering is affected at a temperature of about 850–1000° C. under the application of about 100–300 $kg/cm^2$ pressure for about 0.5–2.0 hours.

6. A voltage non-linear type sintered resistor according to claim 7, wherein the pressure is applied to the resistor body during sintering thereof beginning at about 700° C., and is removed therefrom during cooling thereof at about 800° C.

7. A voltage non-linear sintered resistor according to claim 5, wherein said sintered resistor has a breakdown voltage per unit thickness at a density of electric current of 1 $mA/cm^2$ of about 540–1810 V/mm.

8. A voltage non-linear sintered resistor according to claim 5, wherein said sintered resistor has a non-linearity index of about 30–58.

9. A voltage non-linear sintered resistor according to claim 5, wherein said sintered resistor has a surge withstanding capability of about 180–210 $J/cm^3$ under the application of a 2 ms rectangular wave electrical current.

* * * * *